US011889970B2

(12) United States Patent
Lébl

(10) Patent No.: US 11,889,970 B2
(45) Date of Patent: Feb. 6, 2024

(54) CLEANING DEVICE, IN PARTICULAR FOR ROBOTIC VACUUM CLEANERS

(71) Applicant: Pavel Lébl, Dolní Břežany Lhota (CZ)

(72) Inventor: Pavel Lébl, Dolní Břežany Lhota (CZ)

( * ) Notice: Subject to any disclaimer, the term of this patent is extended or adjusted under 35 U.S.C. 154(b) by 0 days.

(21) Appl. No.: 17/909,721

(22) PCT Filed: Feb. 9, 2021

(86) PCT No.: PCT/CZ2021/000006

§ 371 (c)(1),
(2) Date: Sep. 6, 2022

(87) PCT Pub. No.: WO2021/180254

PCT Pub. Date: Sep. 16, 2021

(65) Prior Publication Data

US 2023/0292969 A1 Sep. 21, 2023

(30) Foreign Application Priority Data

Mar. 9, 2020 (CZ) ..... CZ2020-121
Mar. 9, 2020 (CZ) ..... CZ2020-37313 U

(51) Int. Cl.

| | |
|---|---|
| ***A47L 9/06*** | (2006.01) |
| ***A47L 5/22*** | (2006.01) |
| ***A47L 9/22*** | (2006.01) |
| ***A47L 9/04*** | (2006.01) |

(52) U.S. Cl.

CPC ..... *A47L 9/0693* (2013.01); *A47L 5/22* (2013.01); *A47L 9/0477* (2013.01); *A47L 9/22* (2013.01); *A47L 2201/00* (2013.01)

(58) Field of Classification Search

CPC ..... A47L 2201/00; A47L 9/0693; A47L 5/22; A47L 9/0477; A47L 9/22

See application file for complete search history.

(56) References Cited

U.S. PATENT DOCUMENTS

| | | | | |
|---|---|---|---|---|
| 2003/0132152 | A1* | 7/2003 | Illingworth | A47L 9/08 210/167.1 |
| 2017/0280957 | A1* | 10/2017 | Jeong | A47L 5/30 |
| 2019/0090704 | A1* | 3/2019 | Bosses | A47L 5/30 |
| 2019/0357743 | A1* | 11/2019 | Koura | A47L 9/0488 |

(Continued)

FOREIGN PATENT DOCUMENTS

| | | | | |
|---|---|---|---|---|
| CA | 3123924 | A1 * | 1/2022 | A47L 5/30 |
| CN | 204146956 | U * | 2/2015 | A47L 9/0477 |
| CZ | 34167 | U1 * | 7/2020 | |

(Continued)

OTHER PUBLICATIONS

DE-102018112851-English Machine Translation (Year: 2019).*

(Continued)

*Primary Examiner* — Marc Carlson
(74) *Attorney, Agent, or Firm* — LADAS & PARRY LLP

(57) ABSTRACT

A cleaning device comprising a convex transfer surface disposed between a flat nozzle and a rotary brush. The flat nozzle is formed as a multichannel nozzle between the convex transfer surface and the apron with the bevel of the mouth of the multichannel nozzle ranging from 20 to 60 degrees from the horizontal plane. The clearance height between the convex transfer surface and the floor is preferably in the range of 1 to 8 millimetres.

13 Claims, 15 Drawing Sheets

(56) References Cited

U.S. PATENT DOCUMENTS

| | | | | |
|---|---|---|---|---|
| 2020/0390303 | A1* | 12/2020 | Liu | A47L 9/102 |
| 2021/0052119 | A1* | 2/2021 | Choi | A47L 9/0488 |

FOREIGN PATENT DOCUMENTS

| | | | | | |
|---|---|---|---|---|---|
| DE | 102017208970 | A1 * | 11/2018 | | A47L 9/009 |
| DE | 102018112851 | A1 * | 12/2019 | | |
| EP | 0564222 | A1 | 10/1993 | | |
| KR | 20110061714 | A * | 6/2011 | | |
| KR | 20200045606 | A * | 5/2020 | | |
| KR | 20200101632 | A * | 8/2020 | | |
| WO | WO-2016037635 | A1 * | 3/2016 | | A47L 11/4036 |
| WO | WO-2021043763 | A1 * | 3/2021 | | A47L 9/04 |

OTHER PUBLICATIONS

International Search Report of Application No. PCT/CZ2021/000006 dated Apr. 19, 2021.
Written Opinion of Application No. PCT/CZ2021/000006 dated Apr. 19, 2021.

* cited by examiner

CLEANING DEVICE, IN PARTICULAR FOR ROBOTIC VACUUM CLEANERS

RELATED APPLICATION

This application is an application under 35 U.S.C. 371 of International Application No. PCT/CZ2021/000006 filed on 9 Feb. 2021, which claims priority from CZ Application No. PUV 2020-37313 filed 9 Mar. 2020 and CZ PV 2020-121 filed 9 Mar. 2020 the disclosures of which are incorporated in their entirety by reference herein.

TECHNICAL FIELD

The invention relates to a cleaning device, in particular for a robotic vacuum cleaner, which ensures the supply of fast-flowing air from a spiral housing of a centrifugal fan of a robotic vacuum cleaner directly to the floor surface.

BACKGROUND ART

In the category of robotic vacuum cleaners, a development is currently underway, which largely follows trends in other categories of home appliances and focuses primarily on data sharing and the use of elements of a so-called artificial intelligence.

Above all, these are increasingly financially and energy-intensive navigation systems and applications for smartphones designed to control and monitor the work of the robot remotely. Some of these solutions, such as a rotary laser range finder and a computer that calculates the current position of the robotic vacuum cleaner based on measured changes in distance from objects in the cleaned space, consume about the same amount of energy as all other activities combined, in particular drive wheel drive, fan drive and of all brushes.

The interior of the robotic vacuum cleaner is fundamentally dictated by its external dimensions, which must allow cleaning in restricted conditions, for example between the legs of chairs and under furniture.

The restricted internal space limits the dimensions of the components that must fit in a robotic vacuum cleaner, and, in addition, most components must be in a location designated by functional reasons, and even the battery must be in a location acceptable for balancing the robot. In addition, the collection container for cleaned dirt must also have a certain minimum volume.

It follows that the parameters of the elements that participate in the cleaning activities themselves are very limited and cannot compete comparisons with the parameters and energy sources of normal vacuum cleaners. For example, with a normal, mains-connected vacuum cleaner, the normal power input is 1.000 W and the static negative pressure generated is about 20.000 Pa. With a robotic vacuum cleaner, the power consumption of the fan corresponds to about 6-20 W and generates about 500-2.000 Pa.

An important requirement for optimal vacuuming is to induce a rapid flow of air between the edges of the suction nozzle and the floor surface. It is desirable that the joint through which the air flows is as narrow as possible and the flow rate as high as possible. It is clear that in addition to the size of the joint, the key parameter is precisely the negative static pressure at a certain flow rate, which is able to develop a vacuum cleaner fan, and therefore centrifugal fans equipped with a diffuser are used for this purpose to achieve a cleaning effect, together with the minimal possible joint size. This is not only an obvious relationship between the joint cross-section and the flow rate, assuming a corresponding negative static pressure and flow, but an important assumption is the need to reduce the thickness of the boundary layer at the floor surface. However, achieving a sufficiently narrow joint is difficult with robotic vacuum cleaners.

Related to this is the fact that there is a huge range of impurity dimensions, all of which must be removed from the surface and transferred to a collection container. This is not just dust, which typically has a size in the order of micrometers, but also organic and inorganic particles or objects with dimensions in the order of tens of millimetres, with different densities and aspect ratios. Leaves, crumbs, stones, hair, hairs and so-called dust tufts, which are large formations of low density that bear also electrostatic charges.

These basic requirements for robotic vacuum cleaners are currently being addressed by several technical approaches.

In the first of these technical approaches, the robotic vacuum cleaner uses a pair of counter-rotating rotary feed brushes with a separate suction nozzle. A pair of counter-rotating brushes mechanically removes coarse dirt from the floor surface and uses the kinetic energy mechanically imparted to the dirt to transfer it to the collection container.

Behind the pair of brushes is designed a narrow suction nozzle formed by a pair of elastic elements, which reaches just above the cleaned surface, and the sucked fine dirt is pneumatically discharged into a separate sealed collection container.

This design admittedly reflects the diversity of types of impurities, but not completely. It does not solve objects with a large cross-section and low density, such as typically dust tufts. These occur in large volumes in the corners of the room and under the furniture, are clearly visible and must be removed. However, in the case of the described construction, a problem arises because mechanical brushes cannot give them sufficient kinetic energy due to their low specific gravity and said objects do not reach the collecting container due to their low specific gravity, large cross-section and high aerodynamic drag. They usually end up on the floor again and due to their size they cannot be sucked into a narrow suction nozzle. So they are just moved on the floor in front of the nozzle and are scattered on it when they go out on the carpet.

Another disadvantage is the high space requirements for the installation of all elements and the need for two separate collection containers and therefore the inconvenient emptying of containers and lengthy cleaning. In addition, the system is complex, the dust-free brushes swirl and the hair is intensely wound on the brushes and bearings, which must be removed from both brushes and their bearings.

Another technical solution uses a simple suction nozzle. The biggest problem with this design is related to the specifications of robotic vacuum cleaners. Unlike the suction nozzle of a normal human-operated vacuum cleaner, the robotic vacuum cleaner must have a certain overhead clearance, typically 8 mm, in order to overcome vertical obstacles such as carpets, skirting boards and sills.

Dirt has dimensions up to units of mm and unlike by normal vacuum cleaners, this fact must be taken into account by the suction device of robotic vacuum cleaners. When a person vacuuming the floor sees a crumb, the person simply raises the nozzle and then continues again with the nozzle resting on the surface. The robotic vacuum cleaner must clean everything that passes under the frame of the robotic vacuum cleaner, i.e. all dirt from dust in the size of microns to those 8 mm clearance. The construction of the suction nozzle and the dimensions of the air duct, through which the dirt is transported to the collection container, must correspond to this. In practice, this means that the minimum size of the suction nozzle must be 8 mm, and this also applies to the air duct.

However, this means that with this design it is not possible to achieve a high flow rate at the floor surface due to the large cross-section of the suction nozzle necessary to maintain permeability for large impurities and the limited volume of air flow that the fan is able to supply due to low power input and dimensions. In addition, the nozzles are compressed exactly on the opposite side than would be required, i.e. at the mouth of the front part of the nozzle at the bottom of the frame of the robotic vacuum cleaner. At a floor surface, a flow velocity of only 4-5 m/s is typically achieved.

The suction nozzle must be open from the front side to allow large impurities to pass through and so, paradoxically, although their volume share in the total volume of impurities is only in the order of percent, the need to clean them makes it impossible to create a narrow joint and thus achieve high flow rates, necessary to remove fine dust particles.

At the same time, they make up the majority of impurities by volume and are also far more dangerous to health than large, visible crumbs.

The third design approach is based on a rotating brush, which is located in the vacuum section of the air duct. The rotary brush driven by the electric motor is partially encapsulated and an air duct with negative air pressure opens into the housing. Behind the brush a screen is located that extends just above the floor surface.

Particles of sufficient density and size are hit on the floor by brush blades, transported to the brush shaft and ejected by centrifugal force into the air duct and further into the collecting container. Particles of lower density and fine dust are conveyed to the collecting container by a stream of air, which partially flows around the brush and which is sucked in at the floor.

This technical solution has a number of disadvantages. The air flow rate on the floor is defined by the circumferential speed of the brush and only slightly exceeds it due to the residual flow between the brush blades and the brush housing. The circumferential speed of the brush in a robotic vacuum cleaner is usually 2 meters per second, with a diameter of usually 40 mm and 17 revolutions per second. In the case of a mechanical tool, this speed is sufficient to remove larger impurities, but in the case of air flow it is completely insufficient to separate the impurities from the surface. The air flow in this construction does not serve as one of the primary tools for cleaning the surface, but only as an auxiliary means for the removal and transport of fine dust blown by the brush into the collection container.

This design also suffers from winding the hair around the brush because the surrounding flow is too slow.

A fourth possibility of the prior art is a solution which is based on a pair of profiled counter-rotating elastic cylinders located in a vacuum air duct, which at the same time forms a suction nozzle.

This solution has the following technical disadvantages. The air duct is characterized by sudden changes in cross-section, which causes turbulent flow around the profiled cylinders and problematic sealing of the profiled rotating cylinders. When cleaning carpets, the clearance height of the robotic vacuum cleaner changes due to the high surface load of the drive wheels and thus the geometry of the suction device with respect to the floor changes. The roller profiles sit completely down on the carpet surface and there is a further increase in turbulent flow in the remaining holes between the rollers and the floor. The flow velocity in the remaining holes at the floor was measured at 2 m/s.

Due to the design of the device with small tolerances between the rollers and the shafts, tangled hair is a big problem, which also clogs the channels between the floor and the rollers and blocks the flow of air.

SUMMARY OF THE INVENTION

The invention is based on a design which aims to supply fast-flowing air from a spiral housing or at least one side duct of a centrifugal fan directly to the floor surface, the essence of which consists in that a convex transfer surface is arranged between the flat nozzle and the rotary brush.

The flat nozzle is formed as a multichannel nozzle between the convex transfer surface and the apron with an inclination of the multichannel nozzle orifice in the range of 20 to 60 degrees from the horizontal plane, the clearance height between the convex transfer surface and the floor being in the range of 1 to 8 millimetres.

The convex transfer surface behind the mouth of the flat nozzle continues with a rounded approach and ends with a raised trailing edge, which is part of the rotating brush housing.

The flat nozzle is continuously connected to the spiral housing of the centrifugal fan or at least one side duct by means of a multi-channel air flow straightener, the number of ducts of which connects to a system of individual air ducts that terminate at the inlet to the multi-channel nozzle.

The cross section of the multichannel nozzle decreases in the range between the mouth of the system of individual air ducts in the multichannel nozzle and the mouth of the multichannel nozzle.

The apron is rounded toward the floor from the, multichannel nozzle moth with a maximum clearance height in the range of 0.5 to 2 millimetres and is less than the clearance height of the convex transfer surface at the lowest point relative to the floor surface.

The rotary brush is housed in a housing, which is followed by a vacuum section of the air duct, which is connected by an elastic coupling to the housing of the collecting container.

The rotary brush is housed in the housing between the vacuum section of the air duct, which is connected by an elastic coupling to the housing of the collecting container and the overpressure high-speed part of the air duct of the robotic vacuum cleaner flowing around the floor surface.

The sum of the cross-sections of the outlets of the overpressure air ducts of the high-speed part of the air duct is 3 to 40% of the cross-section of the vacuum section of the air duct.

The cleaning device is suspended on parallel pivoting arms mounted on pins, which are pivotably mounted in lugs anchored to the structure of the robotic vacuum cleaner.

A flat supply channel or at least one side supply channel is arranged between the flat nozzle and the centrifugal fan.

By means of a set of air ducts with a small cross-section, the invention provides a sufficient flow at a given flow rate, while the sufficiently low hydraulic dimension of the individual air ducts creates the conditions for laminar flow. This minimizes energy losses and flow velocities caused by turbulent flow, the flow is evenly distributed along the entire convex transfer surface, and sharp bends in the ducts and abrupt changes in their cross-section are thus eliminated.

The air duct assembly continuously connects the spiral housing outlet of the centrifugal fan to a corresponding small diameter air duct assembly, thereby calming the turbulent flow from the spiral housing outlet of the centrifugal fan. This ensures a smooth physical transition between the different cross-sections and shapes of the spiral housing outlet and the small diameter air ducts, as well as a smooth transition between turbulent air flow from the spiral housing outlet of the centrifugal fan and laminar flow in the small diameter ducts.

The centrifugal fan with a spiral housing can be replaced by a centrifugal fan with at least one side channel, which is an optimal way to transform the kinetic energy of the air, which is obtained from the blades of a rotating impeller, into static energy. The efficiency of the side channel design is significantly higher in the transformation of kinetic energy into static energy than in the use of spiral housings, while minimizing the external dimensions of the centrifugal fan.

The convex transfer surface feeds the high velocity flow layer from the flat multi-channel outlet nozzle to the floor surface. At the lowest ground clearance, the flowing high-velocity flow layer changes the flowing convex transfer surface to the floor surface because the direction of the static pressure differential that presses the high-velocity flow layer against said surfaces changes. Bringing the high-velocity air layer to the floor surface parallel to the floor surface prevents contaminated air from escaping, unlike the sloping direct air flow, because the kinetic pressure in the air layer flowing parallel to the floor means lower static pressure than the surrounding atmosphere. Therefore, air contaminated with dirt cannot escape to the surroundings.

The prior art is also improved by using a significantly simpler nozzle and air duct design, which can be a mere slit, and also by using simpler and cheaper centrifugal fans, which are designed for lower speeds, which reduces the demand on the mounting of the centrifugal fan impeller, its cooling and balancing.

The air flowing rapidly above the surface generates an area of lower static pressure above the surface than below it, namely, for example, between the fibres of the carpet. This creates the desired upward suction, which releases and transports dirt particles from the space between the carpet fibres to the high-speed flow and further to the collecting container.

Unwanted blowing of dirt from the floor surface is thus avoided if some or all of the convex transfer surface moves away from the floor, for example when crossing between. different types of floor coverings, more than the thickness of the flowing layer of the high-speed air stream. At the mentioned. places of the surface, the flow around the surface, is completed up to the trailing edge of the convex transfer surface and the air flow is discharged into the space of the rotary brush, slowed down and discharged into the collecting container.

The convex shape of the transfer surface ensures smooth overcoming of protruding surfaces, such as carpet edges or door sills, and therefore the convex transfer surface can be placed just above the floor and high-velocity flow in a thin layer just above the surface, which is energy efficient.

The working distance between the lowest point of the convex transfer surface and the floor surface is in direct proportion to the vertical dimension of the flat multi-channel nozzle from which the high velocity air jet layer is discharged to the convex transfer surface and the trajectory through which where the current changes the flowed area. When the robotic vacuum cleaner moves on the floor in a standard horizontal position, the joint between the convex transfer surface and the floor surface maintains its defined size, which guarantees the desired change in surface flow.

When the convex transfer surface moves away from the floor surface further than corresponds to the thickness of the flowing layer of the high velocity air stream, the flow of the convex transfer surface is completed only at the trailing edge of the convex transfer surface, defined by the intersection of the convex transfer surface and the inner surface of the rotary brush case and the air stream is discharged into the space of the rotating brush, slowed down and taken to a collecting container.

This redirects the air flow from the floor surface and prevents blowing of dirt from the floor surface and uncontrolled leakage of contaminated air into the atmosphere.

An important aspect is the relationship between the circumferential speed of the rotary brush and the flow rate flowing around the convex transfer surface, which is provided by the control unit. The aim is to maintain a dynamic balance in terms of the mechanical effect of the rotary brush on the dirt particles and the opposite aerodynamic effect of high velocity flow and to maintain a dynamic balance between the volume and velocity of air escaping under the rotary brush and the velocity of particles accelerated by the rotary brush towards the joint. More precisely, the velocity of the air escaping under the brush must slow down to zero even below the body of the robotic vacuum cleaner and no particles must penetrate below the convex transfer surface against the air flow.

The rotary brush acts as a flow rate equalizer in the overpressure and low-pressure branches of the air ducts. The high-velocity flow from the convex transfer surface moves the particles from the floor surface and subsequently this air, saturated with dirt, particles, is forcibly decelerated in temporarily formed chambers between the rotary blade blades to the speed in the suction low-pressure branch to avoid problems with the air flow velocity differential in both branches of the air ducts.

The apron with side plates enclosing the space behind the flat multichannel nozzle with a convex transfer surface with a distance from the floor surface less than the distance of the convex transfer surface from the floor surface limits the amount of air that can be sucked from the ambient. atmosphere into the reduced pressure area due to high velocity flow from flat nozzles and bypassing the cylindrical convex transfer surface.

At the same time, reducing intake air content reduces the problem of maintaining a constant volume of air and reduces the deceleration and growth of the air layer that flows around the cylindrical convex transfer surface, which results in increased floor surface cleaning efficiency.

At the same time, the apron is designed as an aid to ensure a minimum distance between the lower surface edge of the convex transfer surface and the floor surface, thus ensuring the proper function of the air flow below the convex transfer surface.

The entire cleaning device, including the convex transfer surface, the flat multi-channel nozzle, the apron with side plates reducing air intake, the rotary brush with the motor and gearbox, the rotary brush chamber with the vacuum air duct, is connected to the collecting container housing by an elastic transition element and suspended on parallel pivoted arms mounted on the pins on the frame of the robotic vacuum cleaner. This solution compensates changes in the ground clearance of the robotic vacuum cleaner that occur due to the different hardness of the surfaces on which the robotic vacuum cleaner works, i.e. on a wooden floor or a soft carpet. With the usual weight of a robotic vacuum cleaner, the usual difference in ground clearance is up to 3-4 mm.

Maintaining a constant preset clearance height at the lowest edge of the convex transfer surface above the floor surface is important to ensure proper airflow transfer function from the convex transfer surface to the floor surface. This prevents excessive friction and unwanted bending of the rotary brush blades, thus protecting the motor and saving energy, protecting the carpet from excessive wear due to the rotary brush and assisting navigation systems by not introducing unnecessary accelerations that have to be evaluated by robotic vacuum cleaner navigation systems.

A centrifugal high-speed fan with backward curved blades, a semi-closed impeller and a spiral housing produces a high static pressure air flow even at the cost of a lower flow rate. One of the basic ideas of the present invention is a differentiated approach to removing different categories of surface impurities. The primary role of the air flow is to remove fine dust particles for which the high-velocity flow is best suited. If the typical size of these particles, which is measured in micrometers, is taken into account, the decisive factor is not the power of the flow rate or the thickness of the layer of air flowing over the surface to be cleaned. Therefore, a thin layer in the range of 1-2 mm is completely sufficient to remove said particles from the surface and from the space between the carpet fibres.

BRIEF DESCRIPTION OF THE DRAWINGS

An exemplary embodiment of the invention is shown in the accompanying drawings, in which.

DETAILED DESCRIPTION OF THE INVENTION

Figure 1:
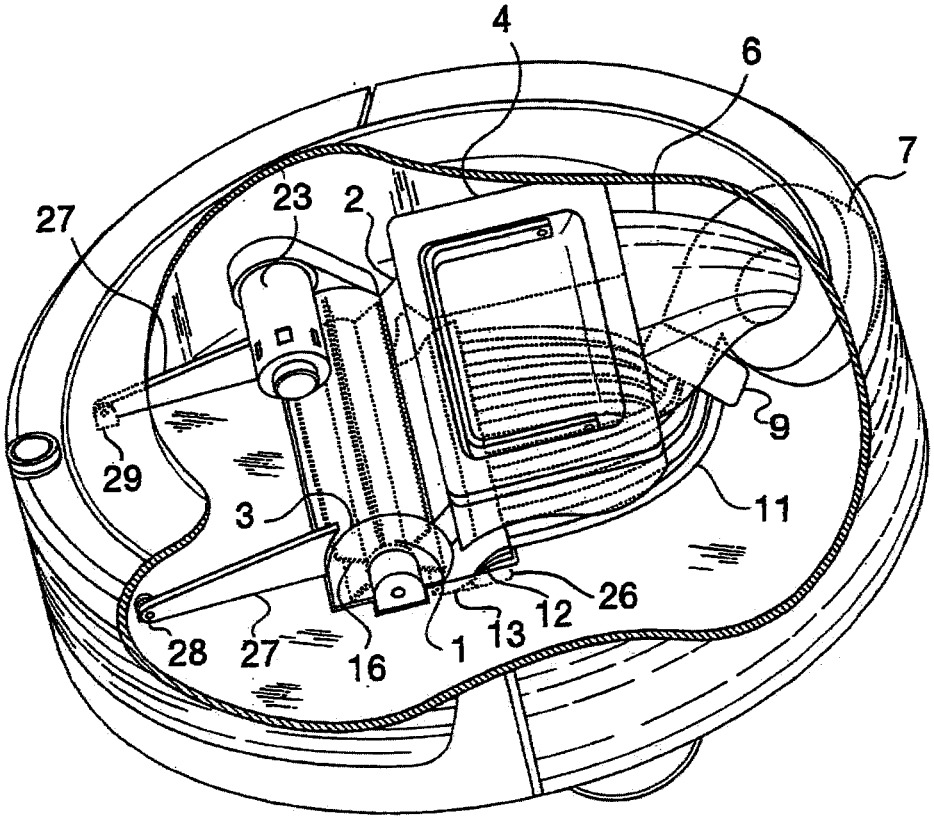
FIG. 1 shows a partial section of a robotic vacuum cleaner in axonometric view showing the location of key features of the invention.

The present invention relates in particular to a robotic vacuum cleaner comprising a partially encapsulated rotary brush 1 driven by an electric motor 8, which is controlled by a control unit in relation to the power input of the electric motor 8 driving a centrifugal fan 7, a vacuum section 2 of air ducts connected to the housing 3 of the rotary brush 1 at one end, and which is connected at the other end via an elastic coupling 22 to the housing of the dirt collection container 4, which is connected via an air filter 5 to an inlet air duct 6 of a centrifugal fan provided with an impeller 46 with blades that are slightly bent backwards and driven by the electric motor 8. The centrifugal fan 7 is encapsulated in a spiral housing 24 with an inlet duct 49 and a side duct 47 with an air outlet 9, and connected to a multi-channel airflow straightener 10 of the air flow, the number of its channels corresponding to the number of outlets to which the same number of air ducts 11 with a small hydraulic dimension is connected at one end, which are on the side of the centrifugal fan 7 connected to the multichannel straightener 10 by a glued joint and at the other end they are mounted in the same number by conical shoulder into recesses in the upper part 12*a* and lower part 12*b* in the circular part of air ducts of the air ducts of the flat multichannel nozzle 12, By means of shaping of air ducts a connection to the same number of flat apertures which form the flat multi-channel nozzle 12 is thereby created. The bar 40 with the holes which serve to pass the air ducts 11 serves as a cap to connect the upper part 12*a* and the lower part 12*b* of the flat multichannel nozzle 12.

Alternatively, instead of a multi-channel straightener 10 with a large number of air ducts 11, one straight flat supply duct or at least one side supply duct with a larger cross-section can be used to connect the spiral housing 24 and the flat nozzle, wherein this technical solution provides also significantly higher outlet air velocity than the speed of the intake vacuum air.

The spiral housing 24 of the centrifugal fan 7 can be replaced by a side channel 47 or a pair of side channels, which are generally arranged below the impeller blade of the centrifugal fan 7. This saves the space of the entire device and, given the dimensions of the centrifugal fan 7, higher static outlet air pressures are achieved.

Figure 17:
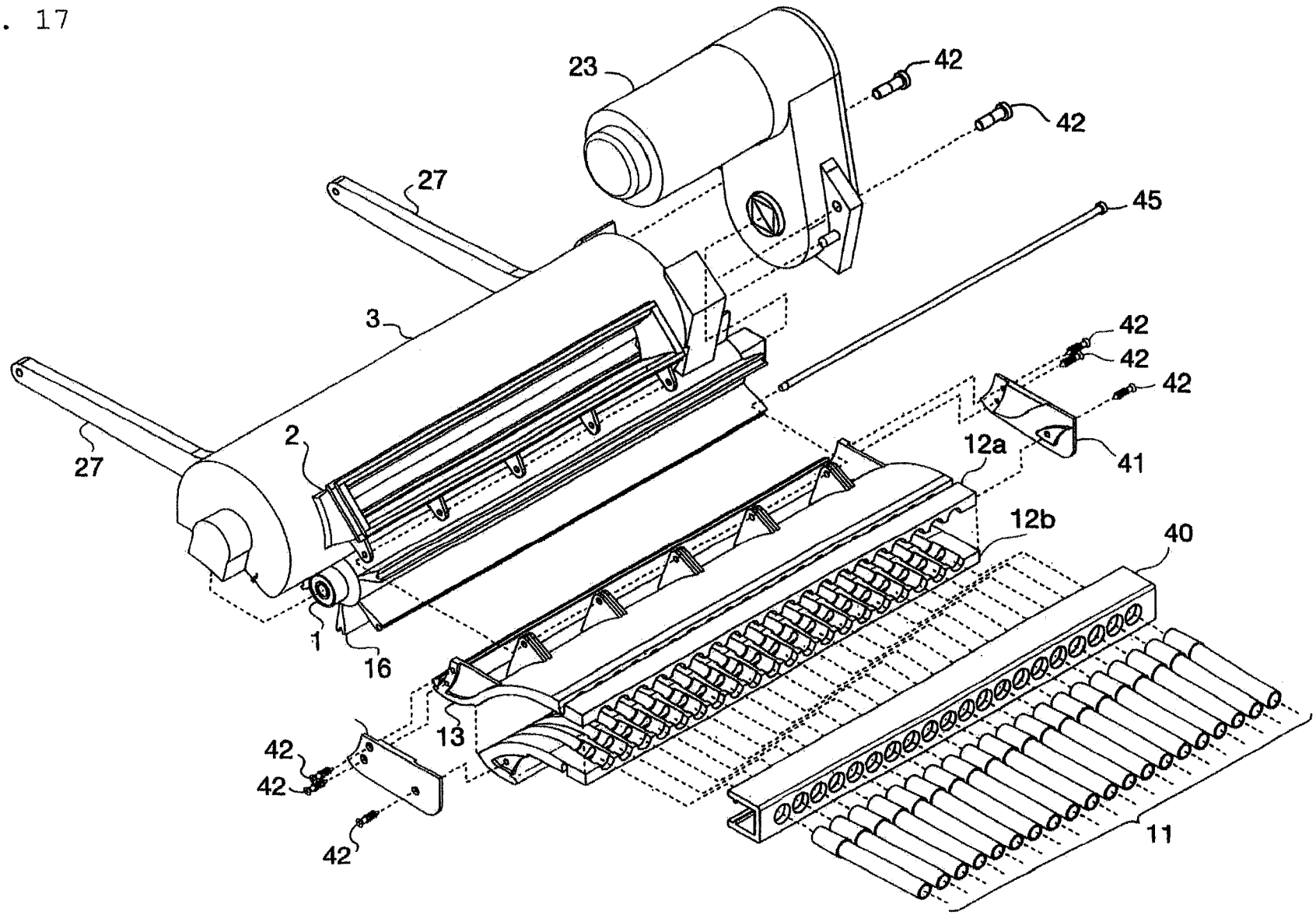
FIG. 17 shows schematically a robotic vacuum cleaner cleaning device between the air duct and rotary brush in an exploded view.
Figure 18:
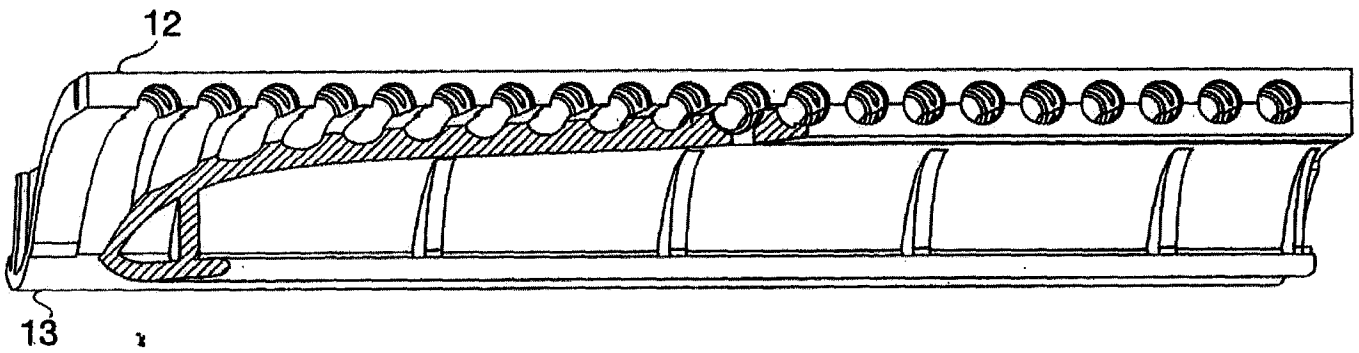
FIG. 18 shows a multi-channel nozzle in partial section.
Figure 19:
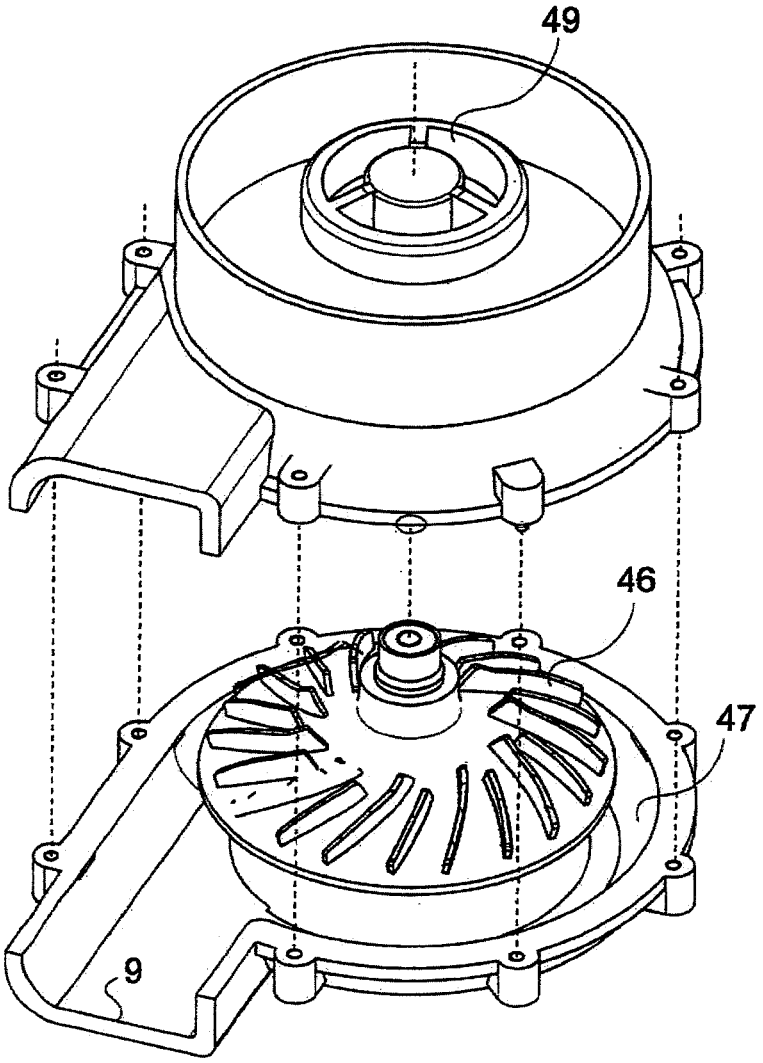
FIG. 19 shows an exploded view of a centrifugal regulator with a side channel.

The flat multi-channel nozzle 12, which is shown in FIG. 17 and FIG. 18, is formed by an upper part 12*a*, which is detachably connected by a rod 45 to the housing 3 of the rotary brush 1 and a lower part 12*b*, which are closed at the side by side plates 41 and connected by connecting elements 42, and is connected to one side of the convex transfer surface 13, which at the other end intersects the inner surface of the housing 3 of the rotary brush 1 driven by the drive motor 23 and thus forms a raised trailing edge 25 of the convex transfer surface 13.

The apron 26 with side plates 41 is arranged below the flat multi-channel nozzle 12. The whole assembly is suspended on pivoting arms 27, which are hinged by means of pins 28 to holes in the lugs 29 on the body of the robotic vacuum cleaner.

The principle of the air recirculation in a robotic vacuum cleaner consists in maintaining a constant flow and total pressure in the entire system, but with changing flow velocities and with analogously changing static and dynamic pressures within the flow. The air ducts are divided into a vacuum low-speed subsystem, which comprises a housing 3 of a rotary brush 1 with the rotary brush 1 itself driven by an electric drive motor 23, and a high-pressure overpressure subsystem comprising a system of air ducts 11 having a small hydraulic size.

The overpressure high-speed subsystem feeds the high-velocity flow into the flat multi-channel nozzle 12 formed by a series of flat outlets, where the flow is further accelerated by reducing the outlet cross-section. Furthermore, the flow is fed along the surface of the convex transfer surface 13 close to the cleaned floor surface 14. After reaching the transfer line 15, where the high-velocity overpressure, flow 17 is closest to the surface of the floor 14, the high-velocity overpressure flow layer 17 has a greater thickness than at the mouth of the outlet openings of the flat multichannel nozzle 12. The increase in air layer thickness as the convex surface 36 is flowed-around, is caused in an undesirable manner y sucking 13 into the lower static pressure region that accompanies the, high velocity overpressure flow 17. The rate of increase in air layer thickness is directly proportional to the length of the trajectory that the flowing air must travel along the surface of the convex transfer surface 13 from the flat multichannel nozzle orifice to the transfer line 15 because the flowing layer is exposed to ambient air along the entire length of the trajectory. To limit such growth, an apron 26 with side plates 41 is designed, wherein the side plates 41. limit the penetration of ambient air to the surface of the convex transfer surface 13, and thus limit the degree of undesired suction 18 and thus also the increase in the thickness of the air layer.

Upon reaching the transfer line 15, the high velocity overpressure flow 17 changes the flowed-around surface from the convex transfer surface 13 to the floor surface 14, because said floor surface 14 forms in the transfer line 15 a tangent surface of the, convex transfer surface 13. At the same time, the sign of the differential of the static pressures acting on the high-velocity flow layer changes in the transfer line 15.

Said static pressure differential arises from the fact that on the solid surface side an overpressure from the free atmosphere side acts on the flowing air layer characterized by a higher dynamic and lower static pressure, which presses the flowing layer against the solid surface.

The high-velocity overpressure flow 17, entraining dirt particles, flows around the cleaned floor surface 14 against. the blades 16 of the rotary brush 1, which rotates with the circumferential velocity vector opposite at a lower dead centre than the high velocity overpressure flow vector 17, wherein its speed at a given cross section corresponds to a circumferential velocity of 5-10% of the velocity of the high-velocity overpressure flow 17. The dirt particles together with any large objects 21 which have been picked up by the blades 16 of the rotary brush 1 find themselves together with the counter-moving particles entrained by the high velocity overpressure flow 17 in strongly turbulent flow upon contact of the high-speed overpressure flow 17 with the blades 16 of the rotary brush 1 and are carried by the rotary brush 1 between adjacent pairs of blades 16 of the rotary brush 1 into the vacuum section 2 of the air duct and carried by slow flowing air into the dirt collection container 4, where they are stopped by an air filter 5.

A pair of adjacent blades 16 of the rotary brush and the inner wall of the housing 3 of the rotary brush 1 during its rotation form a temporary closure of the chamber 31 at the moment of passing through the housing 3, where due to a strong turbulence and vortex formation dissipation of the kinetic energy and increase of its static pressure take place, so that at the entry of the slowed down turbulent air 39 into the space of the vacuum section 2 of the air duct the flow has comparable velocity and pressure parameters as are naturally developed in the vacuum section 2 of the air duct by the centrifugal fan 7.

The connection between the operation of the overpressure and low-pressure air subsystem means that the two air subsystems are not only structurally but also functionally connected by a partially encapsulated rotary brush 1, thus representing the first aspect of synergistic interaction of the high velocity overpressure flow 17 and the rotary brush 1 itself.

It is precisely the location of the rotary brush 1 with the blades 16 between the vacuum section 2 of the air duct and the high-velocity overpressure flow 17 flowing around the floor surface 14, which allows the desired high velocity differential between the low-pressure and overpressure flow to be used.

In a preferred embodiment, the ratio between the flow velocity at the mouth of the flat multichannel nozzle 12 and the velocity in the vacuum section 2 of the air duct is 16:1, more precisely, the flow velocity in the vacuum section 2 of the air duct is 5 m/s and at the mouth of the flat multichannel nozzle 12 60 m/s.

It is clear that without the forced deceleration which takes place inside the housing 3 of the rotary brush 1, the speed could not be reduced at short distances between the transfer line 15 and the vacuum section 2 of the air duct, because in a natural way, i.e. by friction between the high velocity flow and ambient atmosphere, the speed compensation would require the distance about 500 mm.

The low flow rate in the vacuum section 2 of the air duct is dictated by the need for sufficient permeability of the vacuum section 2 of the air duct, because all dirt particles including large objects 21 passing under the robot body must have enough space to pass safely through the vacuum section 2 of the air duct to the collecting container 4 which is housed in a shaft with a wall 32. In contrast, in the case of an overpressure air duct 11, no such restriction exists. For this reason, the cross-section of the overpressure air duct 11 or the sum of the cross-sections of the individual overpressure air ducts and their outlet in the flat multichannel nozzle 12 can be reduced in comparison with the cross-section of the vacuum section 2 of the air duct. In a preferred embodiment, the sum of the cross-sections of the outlets of the overpressure air ducts 11 is about 5% of the cross-section of the vacuum section 2 of the air duct. The result is a desirable increase in flow rate which, despite a slight deceleration during the flow around the convex transfer surface 13 due to friction with ambient air accompanied by turbulences 35, positively affects the cleaning effect on the floor surface 14 because the high velocity flow generates an area of reduced static pressure above the floor surface 14 and thus causes the desirable upward suction 19, which also releases otherwise inaccessible dirt from the space between the carpet fibres.

For the effectiveness of the cleaning effect, the angle of the mouth of the flat nozzle or the multichannel nozzle 12, which it encloses with the floor surface 14, is also important. The increase in this angle is associated with an extension of the trajectory that the air must travel between the mouth of the multichannel nozzle 12 and the transfer line 15. The air velocity decreases due to the turbulence 35 and the volume of the air sucked in and the thickness of the air layer in the transfer line 15 increase due to the undesired suction 18.

The upper limit of the angle is limited by the condition that the separation indicated by the separation line 37 does not take place before the air reaches the raised trailing edge 25. This is related to the ratio of the thickness of the flowing air layer to the radius of the convex transfer surface 13. The lower is this ratio, the sooner the air separates from the convex transfer surface 13, and the lower is the upper limit of the angle of the mouth of the flat nozzle or the multi-channel nozzle which it forms with the floor surface 14.

The lower limit of this angle is limited by two factors. In the case of a multi-channel nozzle 12, the individual air streams need to be combined into one stream, at the level of the transfer line 15. This depends on the length of the trajectory, the size of the daps between the outlets of the individual channels and the shaping of the ends of the individual channels, which may be designed to be tapering or widening. In the case of all flat nozzles, the smallest angle is given by the fact that the nozzle body and the adjoining apron 26 do not represent an obstacle for the robotic vacuum cleaner, for example when crossing unevenness or sills.

Beyond the traditional technical task of the rotary brush 1, which consists in collecting coarser dirt from the floor surface 14, tapping the cleaned floor, especially carpets and transporting loose dirt to the vacuum section 2 of the air duct, the rotary brush 1 with blades 16 in this preferred embodiment of the present invention serves as a flow rate moderator between the high-speed flow from the overpressure subsystem providing a sufficient cleaning effect and the low-speed vacuum subsystem with a large cross-section, enabling the transport of even large particles of dirt to the collecting container 4.

The transfer line 15, on which the high-velocity overpressure flow around the convex transfer surface 13 is closest to the floor surface 14 and changes the flowed-around surface from the convex transfer surface 13 to the floor surface 14, must be as close as possible to the rotary brush 1 with blades 16, so that the highest possible number of dirt particles released from the floor surface 14 by the high-speed overpressure flow are conveyed due to the inertial force up to the blades 16 of the rotary brush 1. In particular, high-density particles, when released from the surface, move along a trajectory similar to a ballistic curve, because the flow velocity that set them in motion decreases rapidly, although it still far exceeds the velocity of these particles. The clearance height of the convex transfer surface 13 is most often in the range of 1 to 8 millimetres and also depends on the vertical dimension of the flat nozzle, because in the case of a thin layer of air washing the convex transfer surface 13 which would be too far from the floor 14, the air flow would not be transferred from the convex transfer surface 13 to the floor 14, the air would flow up to the raised trailing edge 25 and the system would not work.

At the same time, it is desirable that in the space between the blades 16 and the transfer line 15 the flow rate be as high as possible so that the particles mechanically released by the blades 16 of the rotary brush 1 are deflected upwards into the space of the housing 3 of the rotary brush 1 by the flow-induced aerodynamic force. In this way, the penetration of said particles through the slit 20 below the transfer line 15 is prevented.

Since the distance 43 between the lowest level of the convex transfer surface 13 and the lowest level of the rotary brush 1 must be short, the velocity of the high velocity overpressure flow 17 is much higher at the point when it reaches the blade 16 than the velocity of most particles released and agitated by this flow, and at the same time many times exceeds the flow rate in the vacuum section 2 of the air duct. In order to prevent backflow from the vacuum section 2 of the air duct, which would occur due to a large flow velocity differential, the high-speed overpressure flow 17 must be decelerated in a controlled manner, resulting in decelerated turbulent air 39 having a velocity equal to or close to the flow velocity in the vacuum section 2 of the air duct. In the presented preferred embodiment of the present invention, this object is achieved by using the blades 16 of the rotary brush 1 as described above.

An important characteristic for the function of the robotic vacuum cleaner according to the present invention is the ratio of the sum of the cross-sections of the outlet of the overpressure air ducts 11 of the high-speed part of the air duct, which is 3 to 40% of the cross-section of the vacuum section 2 of the air duct. The upper limit of this range is possible when using low-pressure centrifugal fans.

Because the robotic vacuum cleaner works on floors autonomously, it must be able to overcome vertical obstacles such as carpets, skirting boards and thresholds. When the robotic vacuum cleaner overcomes an obstacle, its cleaning elements, which are primarily the rotating brush 1 and the flat multi-channel nozzle assembly 12 with the convex transfer surface 13, change their position relative to the floor surface 14.

Figure 11:
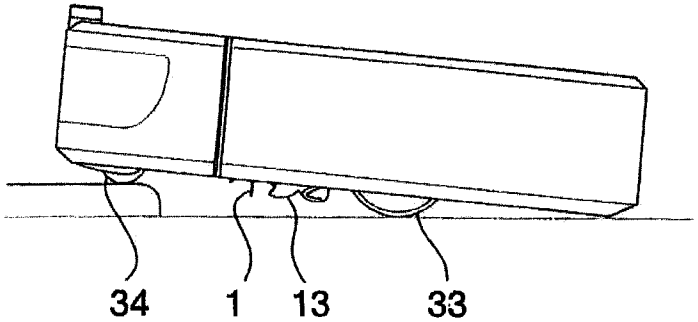
FIG. 11 shows a front view of the robotic vacuum cleaner in an inclined, crossing position.
Figure 12:
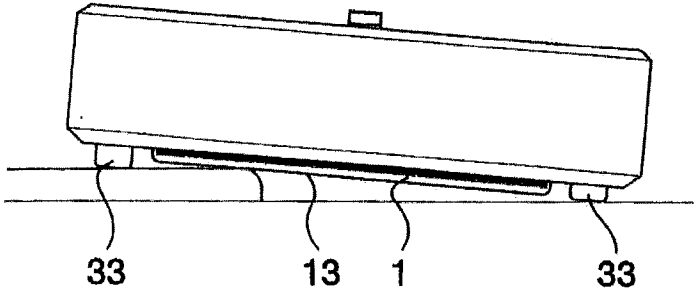
FIG. 12 shows a side view of the robotic vacuum cleaner in an inclined, crossing position.
Figure 14:
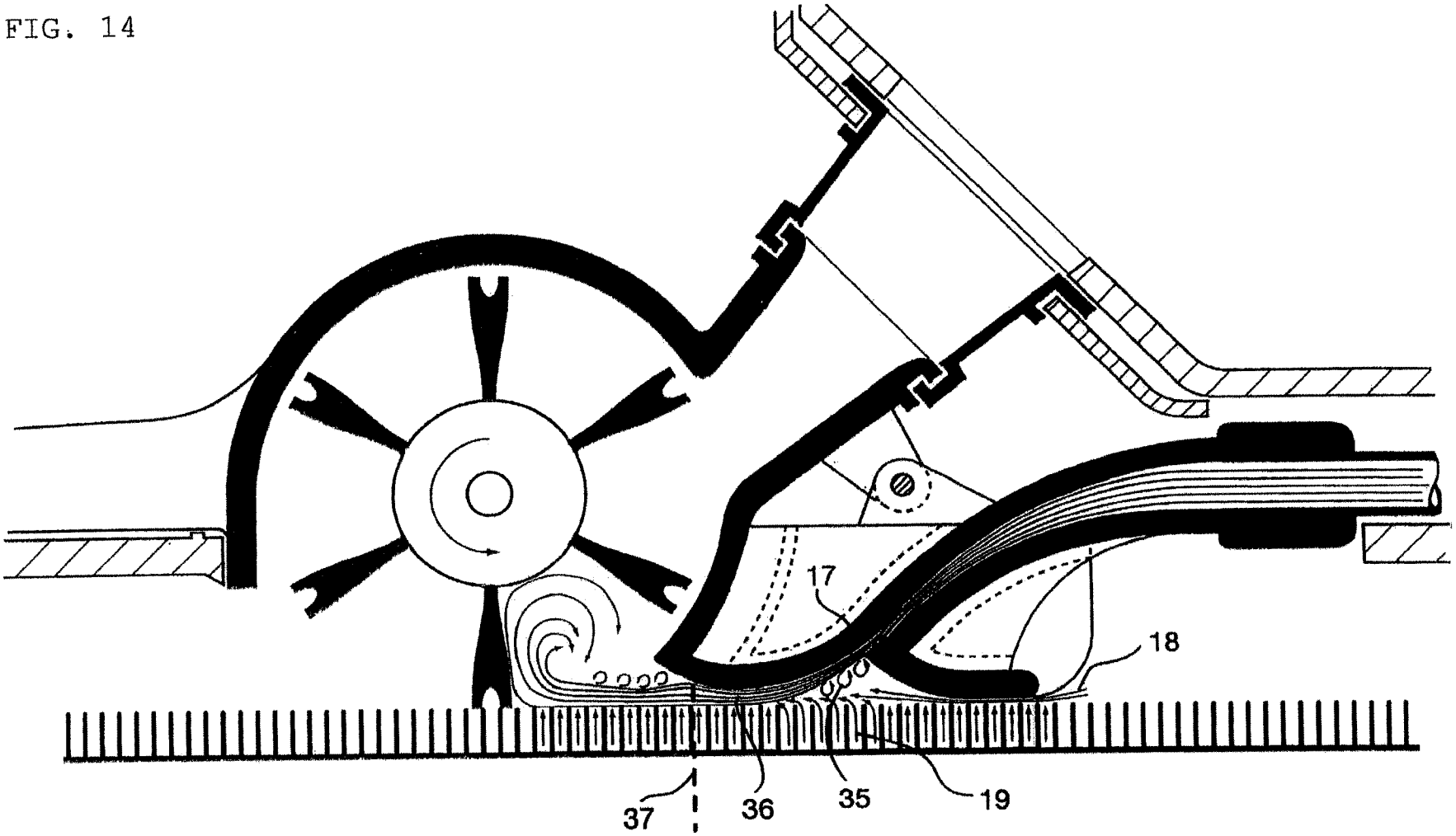
FIG. 14 shows a detailed embodiment of a robotic vacuum cleaner cleaning device when working on a carpet at a stage where dirt comes into contact with the rotary brush.
Figure 15:
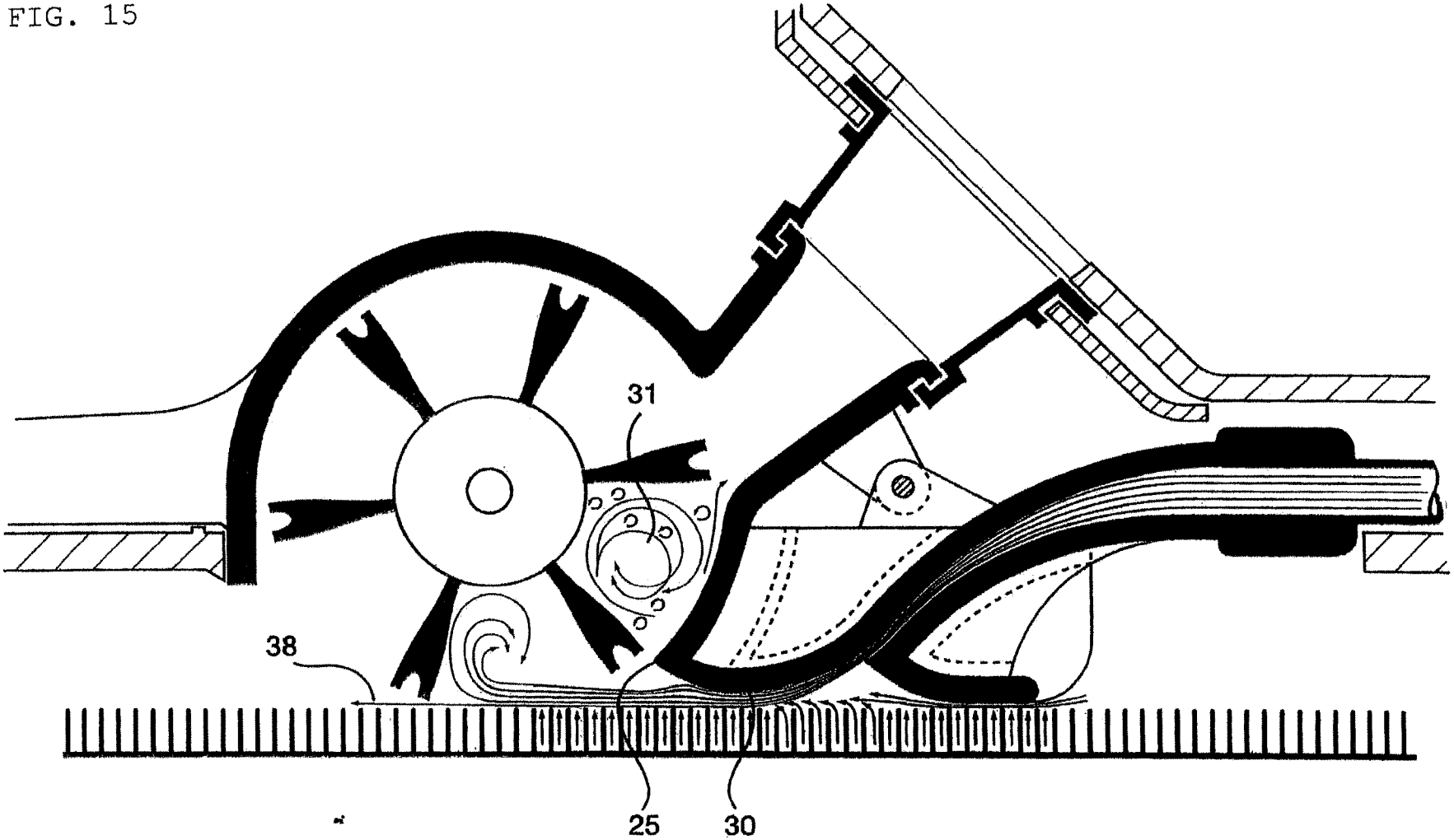
FIG. 15 shows a detailed embodiment of a robotic vacuum cleaner cleaning device when work on a carpet at a stage where dirt is carried in the space between rotary brush blades and rotary brush housing.
Figure 16:
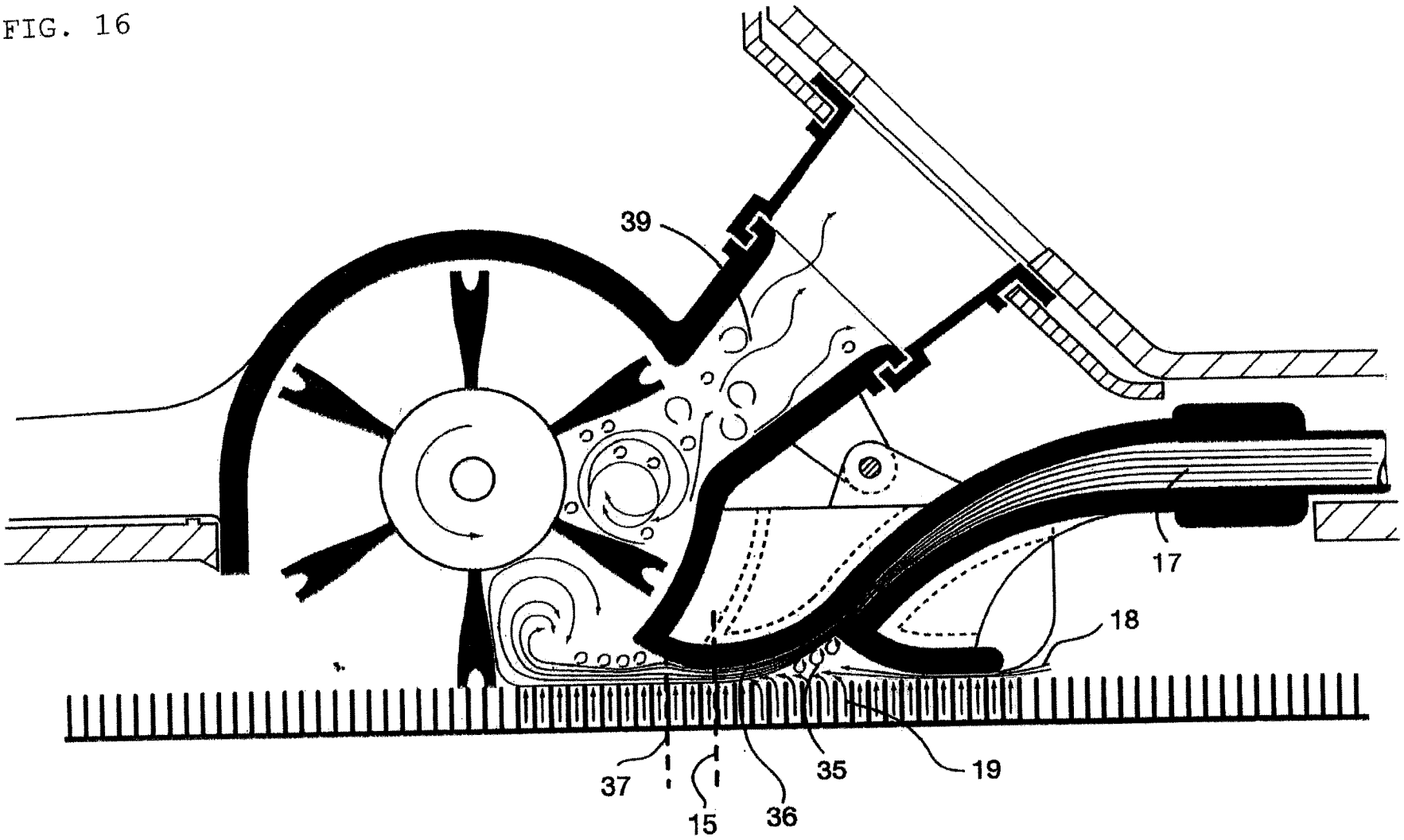
FIG. 16 shows a detailed embodiment of a robotic vacuum cleaner cleaning device when working on a carpet at a stage when dirt is expelled by the rotary brush blades from the space between the blades into the vacuum section.

At the moment when the rotary brush 1 and the flat multichannel nozzle assembly 12 with the convex transfer surface 13 are raised, as shown in FIGS. 11 and 12, in whole or in part above the floor surface 14 so that the distance between the, transfer line 15 and the floor 14 exceeds the thickness of the flowing air layer, the high-speed overpressure flow 17 from the multichannel nozzle 12 flowing around the convex transfer surface 13 does not change the flowing surface to the floor surface 14 but flows around the convex transfer surface 13 up to the raised trailing edge 25, which directs the flow directly into the housing 3 of the rotary brush 1. This prevents air from escaping into the atmosphere and swirling dirt on the floor surface 14.

The apron 26 with side plates limits the unwanted suction 18 of air which is sucked from the ambient atmosphere into the reduced pressure region caused by the high velocity flow from the flat multi-channel nozzle 12 and by the flow-around the convex transfer surface 13.

The apron 25 with the side plates 41 encloses the space behind the convex transfer surface 13 and is characterized by a smaller clearance height than corresponds to the distance of the transfer line 15 from the floor surface 14.

The compensation for the increase in air volume due to its desired suction 19 and unwanted suction 18 takes place in a controlled manner by escaping pulsating air 38 through a periodically generated by the pulsating gap 44 under the blades 16 of the rotary brush 1 so that the flow velocity under the rotary brush 1 decreases to 0 m/s still under the body of the robotic vacuum cleaner. Due to the fact that even within this flow the static pressure is lower than in the surrounding atmosphere and the flow stops under the robotic vacuum cleaner, there can occur no leakage of impurities into the surrounding atmosphere.

There are two other aspects of the synergistic action between the rotary brush 1 and the high-speed overpressure flow 17.

The first of them is related to the usability of the rotary brush 1, more precisely to its circumferential speed. The higher is the circumferential speed of the rotary brush 1, the higher the effect on the dirt and the cleaning effect have the blades 16. More specifically, a positive effect has the higher number of interactions between the blades 16 and the floor surface 14 per unit time, because increases the probability of dirt intervention and the intensity of dirt release from carpet fibres.

In the prior art of robotic vacuum cleaners, the speed of rotation of the rotary brush and thus its circumferential speed is limited, because the speed of vacuum flow along the brush is low for previously described reasons and behind the brush there are only a mechanical apron which must maintain a certain ground clearance 30 above the floor surface, so as not to prevent the robot from moving and overcoming vertical obstacles.

In the present preferred embodiment, the mechanical apron is replaced by the pneumatic effect of a counter-rotating high-speed overpressure flow 17, which completely seals the space between the transfer line 15 and the floor surface 14. Thanks to the described sealing means, it is thus possible to significantly increase the rotation speed of the rotary brush 1 in comparison with the prior art. The higher the speed of the high-speed overpressure flow 17, the higher the rotation speed of the rotary brush 1 can be used. That is, each increase in the speed of the high-speed overpressure flow 17 has a multiplier effect, because the circumferential speed of the rotary brush 1 and the consequent increase in the cleaning effect is also increased.

The second synergistic effect relates to the effect of the blades 16 on the particles trapped between the carpet fibres. The blades 16 strike dirt particles on the surface, in particular on the surface of the carpet, at a frequency which, at normal speeds of 1000 rpm and about 17 revolutions per second, corresponds to a frequency of about 100 strokes per second in a conventional paddle brush. At this frequency, the fibres of the carpets with the trapped dirt particles are hit and bent, causing them to be mechanically released and a considerable part is moved closer to the surface or jumps to the surface. These particles are then cleaned either directly or secondarily by the high-speed overpressure flow 17 on the basis of the previously described mechanisms.

The flat multi-channel nozzle 12, the apron 26 with side plates 41 reducing the air intake, the convex transfer surface 13, the rotary brush 1 with the electric motor 8 and gearbox, the housing 3 of the rotary brush 1 with its vacuum section 2 of the air duct, which is by an elastic coupling 22 connected to the wall 32 of the housings of the collecting container 4, are suspended as a whole on parallel pivoted arms 27 suspended on pins 28 on lugs 29 of the robotic vacuum cleaner structure.

This suspension compensates for changes in the ground clearance of the robotic vacuum cleaner that occur due to the different hardness of the surfaces on which the robotic vacuum cleaner works, such as a wooden floor or a soft carpet. With the usual density of a robotic vacuum cleaner, the usual difference is 3-4 mm.

Figure 2:
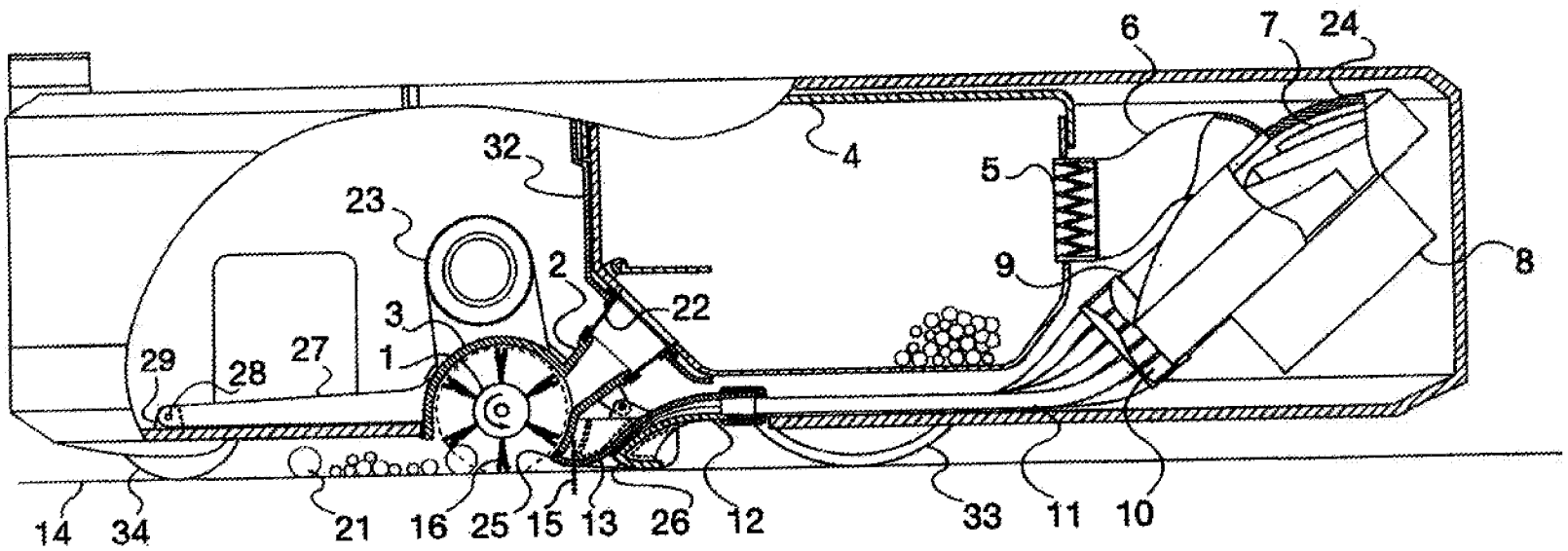
FIG. 2 shows a partial section of a robotic vacuum cleaner showing the position of a cleaning device

The position of the self-levelling structure on a hard surface is shown in FIG. 2. On the hard surface, the relative vertical position of the drive wheels 33 and the auxiliary wheel 34 with respect to the self-levelling structure, in particular with respect to the vertical position of the blades 16, more precisely to the vertical position of the axis of the rotary brush 1 where the blades 16 of the rotary brush 1 move closely slidably against the floor surface 14 is clearly defined, and the apron 26 with the side plates has a clearance height of about 1 mm above the floor surface 14.

Figure 3:
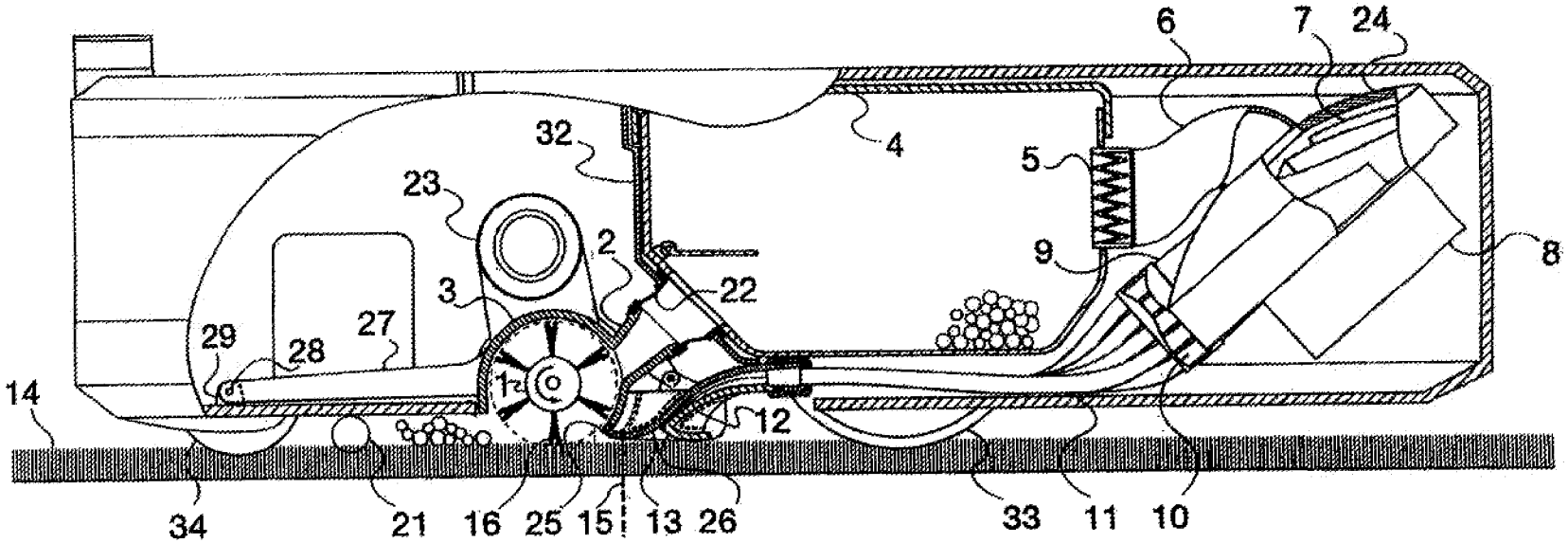
FIG. 3 shows a partial section of a robotic vacuum cleaner indicating the position of the cleaning device when the robotic vacuum cleaner is driving on a soft surface.
Figure 4:
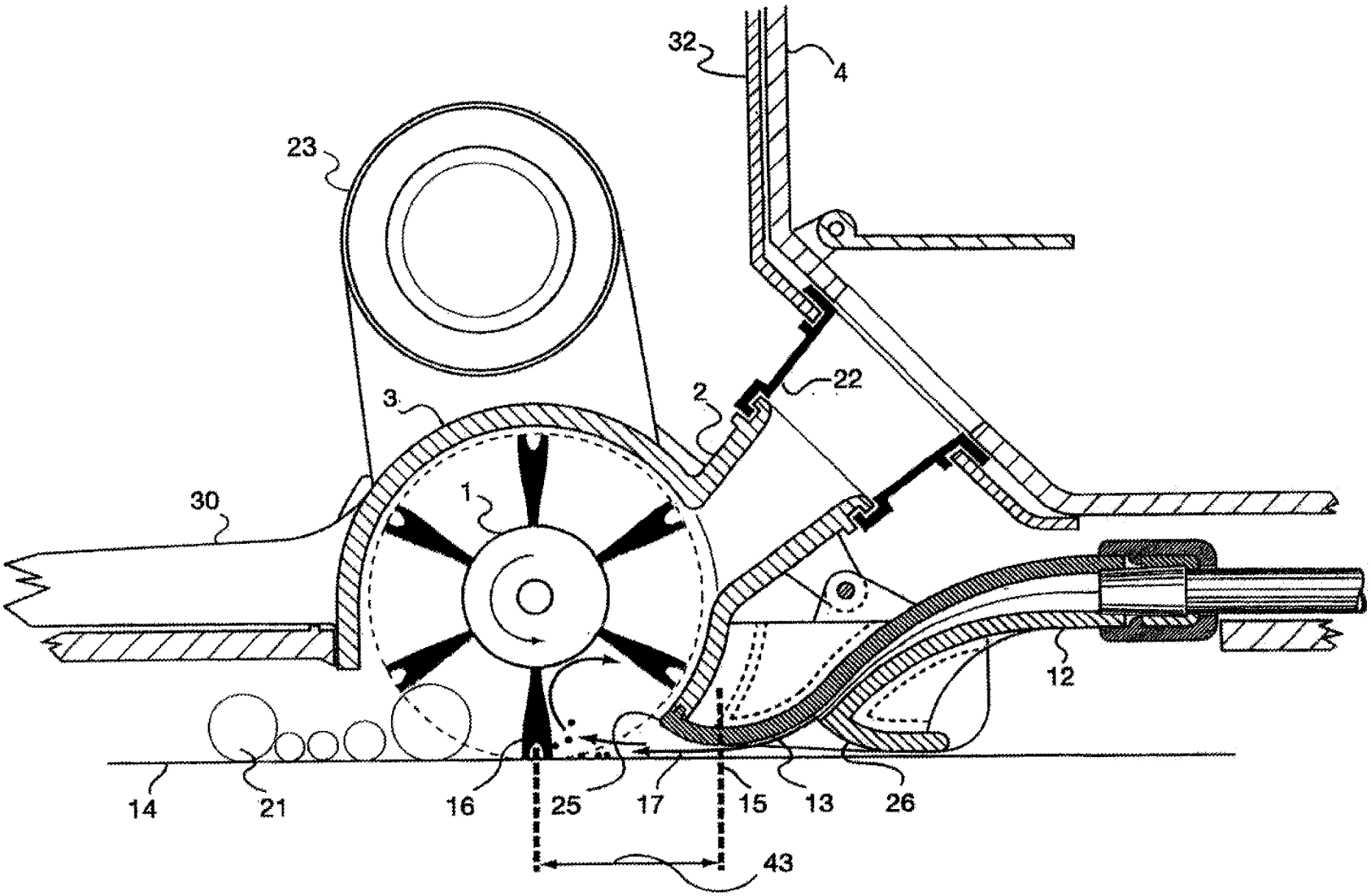
FIG. 4 shows a detailed section of a robotic vacuum cleaner cleaning device with a rotary brush, a rotary brush housing, a flat multi-channel nozzle, an apron with side plates and a vertically movable hinge.
Figure 5:
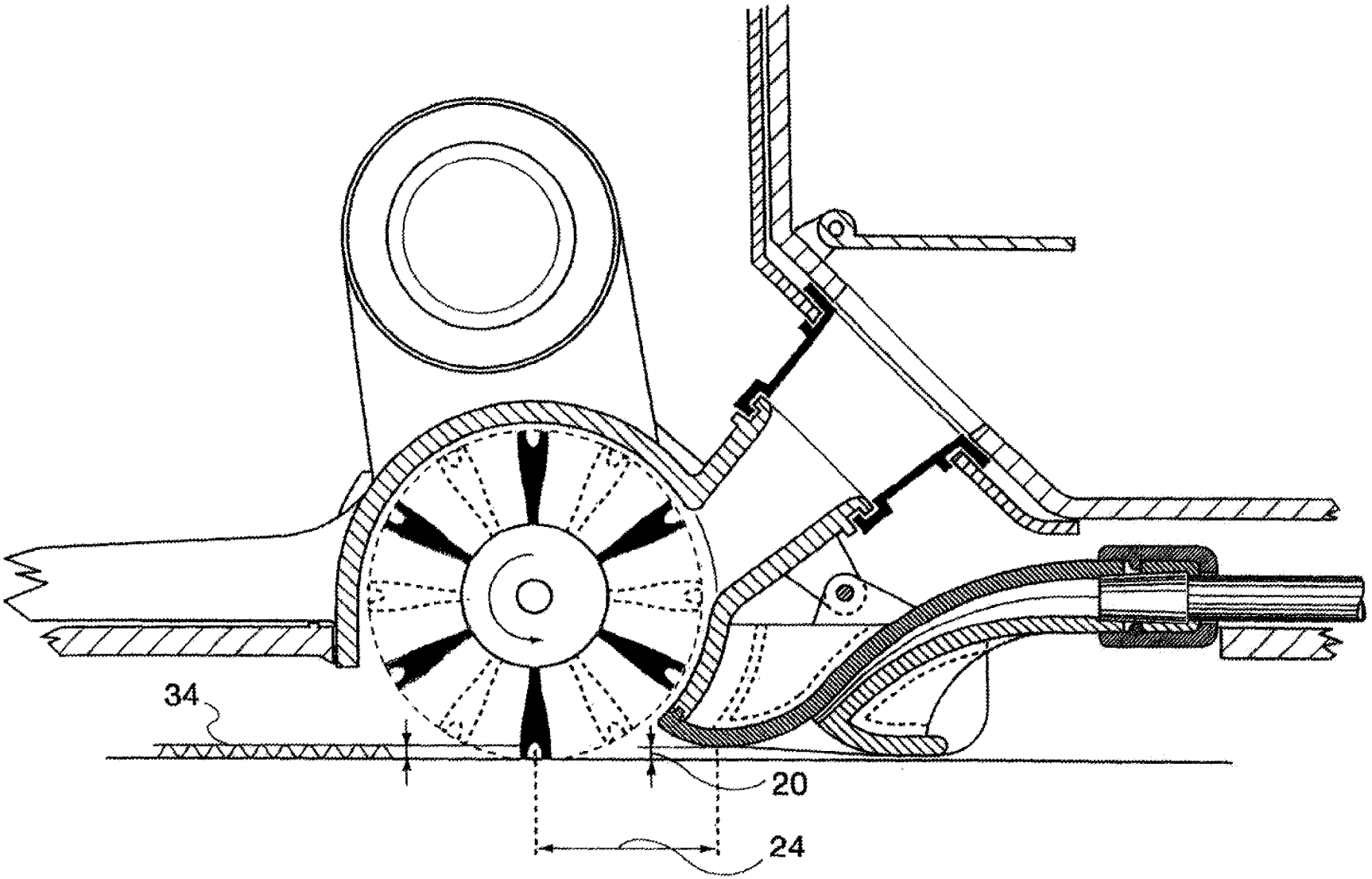
FIG. 5 shows a detailed section of the cleaning device indicating the air flow under the rotary brush blades.
Figure 6:
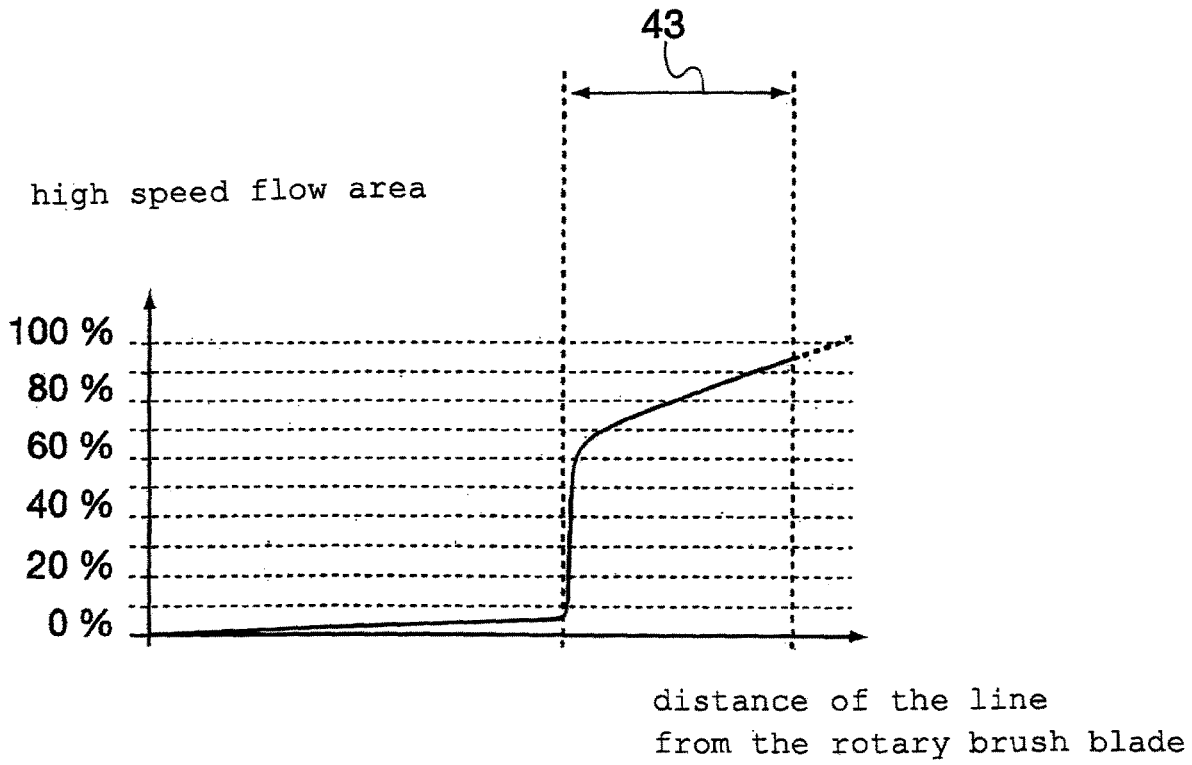
FIG. 6 shows schematically the dependence of the change in flow speed on time and the size of the slit under the rotary brush blades.
Figure 7:
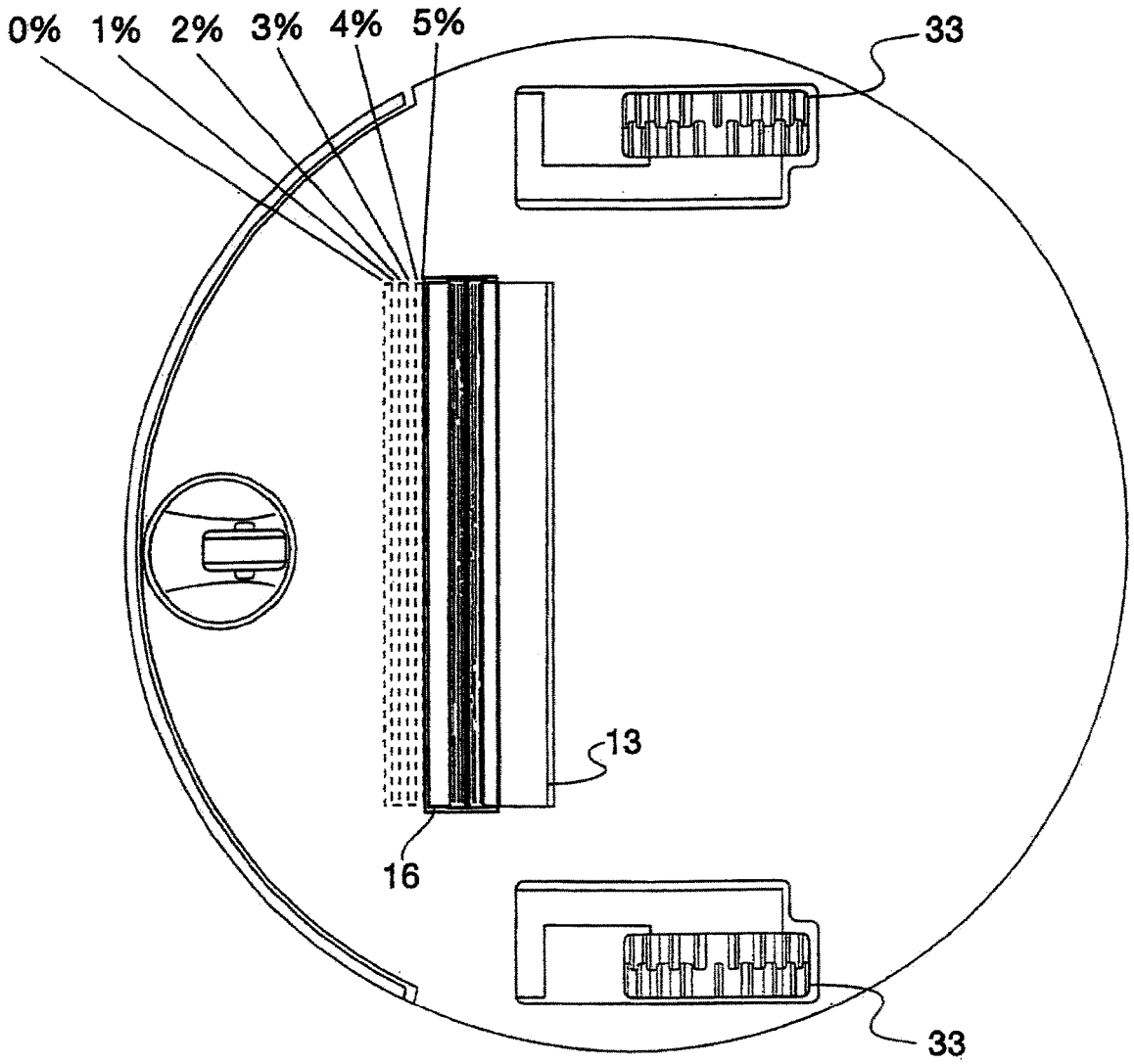
FIG. 7 shows a bottom view of the robotic vacuum cleaner body with indication of the course of the flow velocity under the blades of the rotary brush.
Figure 10:
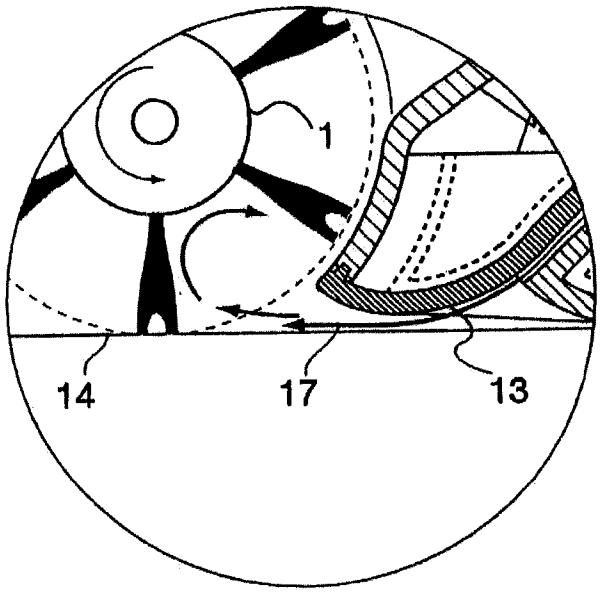
FIG. 10 shows a detailed section of the cleaning device indicating the air flow at a horizontal, working position.
Figure 8:
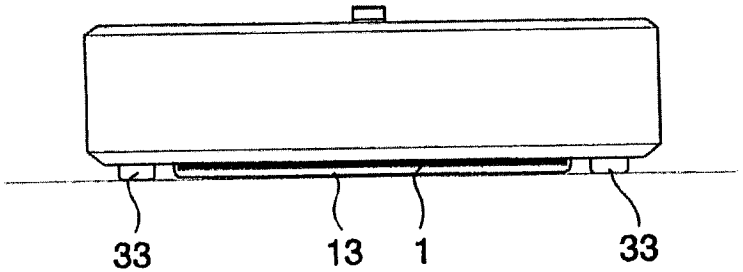
FIG. 8 shows a front view of the robotic vacuum cleaner in a horizontal, working position.
Figure 9:
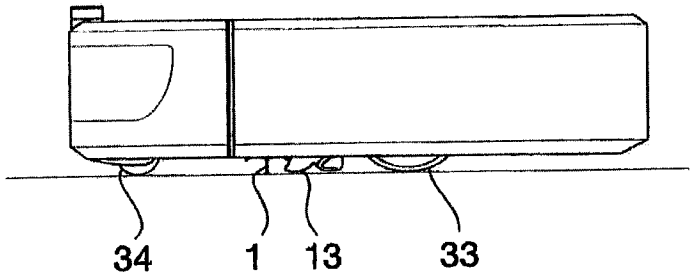
FIG. 9 shows a side view of the robotic vacuum clearer in a horizontal, working position.
Figure 13:
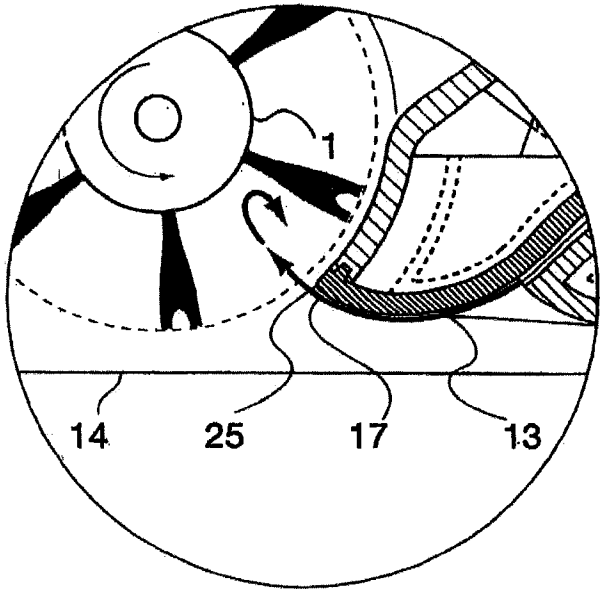
FIG. 13 shows a detailed section of the cleaning device indicating the air flow in the inclined, crossing position of the vacuum cleaner.

FIG. 3 shows the position of said structure on a soft surface, where the drive wheels 33 and the auxiliary wheel 34 are immersed in the soft surface of the floor 14, and therefore the ground clearance of the robotic vacuum cleaner is reduced. On a soft surface, the self-levelling structure, which is suspended on the swing arms 27, slides into the body of the robotic vacuum cleaner and rests on the sliding surface of the apron 26 and the rotating blades 16 of the rotary brush 1, which are immersed about 1 mm below the carpet surface.

INDUSTRIAL APPLICATION

The present invention can be used in particular for robotic vacuum cleaners, which aim to supply fast-flowing air from the spiral housing of a centrifugal fan of a robotic vacuum cleaner directly to the floor surface.

LIST OF REFERENCE CHARACTERS

1 rotary brush
2 vacuum section
3 housing
4 collection container
5 air filter
6 inlet air duct
7 centrifugal radial flow fan
8 electric motor
9 air outlet
10 multichannel straightener
11 air duct
12 multichannel nozzle
**12*a*** upper part
**12*b*** lower cart
13 convex transfer area
14 floor
15 line
16 blade
17 high-speed overpressure flow
18 unwanted suction
19 desirable suction
20 gap
21 large objects
22 elastic coupling
23 drive motor
24 spiral housing
25 raised trailing edge
26 apron
27 pivoted arm
28 pin
29 lug
30 approach
31 chamber
32 wall
33 drive wheel
34 auxiliary wheel
35 turbulence
36 circulation around a convex surface
37 separation lines
38 escaping pulsating air

39 decelerated turbulent air
40 bar
41 side plate
42 fasteners
43 distance
44 pulsating gap
45 rod
46 impeller
47 side channel
49 input channel

The invention claimed is:

1. A device for cleaning a horizontal surface, the device comprising:

(a) a fan having an inlet side and an outlet side;

(b) a rotary brush comprising a plurality of rotating blades, the rotary brush positioned within a rotary brush chamber which is connected to the inlet side of the fan to create a negative air pressure therein;

(c) an overpressure subsystem for receiving positive pressure air from the outlet side of the fan and for delivering a high velocity overpressure flow through a flat nozzle onto the horizontal surface in a forward direction toward the rotary brush blades;

wherein the flat nozzle is elevated above the horizontal surface when the device is disposed on the horizontal surface; and wherein the flat nozzle has an outlet comprising a convex transfer surface having a convex curvature that, as viewed from the flat nozzle, first curves toward the horizontal surface to a transfer point that is a point of the convex transfer surface that is closest to the horizontal surface and then curves away from the horizontal surface to a raised trailing edge adjacent the rotary brush chamber, the convex transfer surface being disposed and arranged within the device such that as the high velocity overpressure flow leaves the flat nozzle it passes along the convex curvature between the convex transfer surface and the horizontal surface until the high velocity overpressure flow reaches the transfer point on the convex transfer surface whereupon the flow of air is tangential to the horizontal surface and a change in static pressure acting on the high velocity overpressure flow by virtue of the convex curvature of the convex transfer surface causes the flow of air to pass along the horizontal surface in the forward direction toward the rotary brush blades.

2. The device according to claim 1, wherein the outlet of the flat nozzle further comprising an apron disposed at the outlet opposite the forward direction of high velocity overpressure flow to limit penetration of ambient air to the convex transfer surface, wherein the flat nozzle is a multi-channel nozzle disposed between the convex transfer surface and the apron, the multi-channel nozzle having an orifice that is inclined from 20 to 60 degrees from the horizontal surface, wherein a clearance height between the transfer point of the convex transfer surface and the horizontal surface is in a range of 1 to 8 millimeters.

3. The device according to claim 2, wherein the fan is a centrifugal fan that is housed in a spiral housing, wherein the flat nozzle is continuously connected to the spiral housing or at least to one side channel thereof by a multi-channel air flow straightener, the multi-channel air flow straightener having a plurality of channels that connect to a system of individual air ducts, wherein the individual air ducts terminate at an inlet to the multi-channel nozzle.

4. The device according to claim 3, wherein the multi-channel nozzle has a cross section that decreases between a mouth of the individual air ducts and a mouth of the multi-channel nozzle.

5. The device according to claim 3, wherein the rotary brush chamber is accommodated in a housing, and connected to a collecting container by an elastic coupling.

6. The device according to claim 2, wherein the apron is rounded towards the horizontal surface away from the mouth of the multi-channel nozzle, and wherein the apron has a minimum clearance height in a range of from 0.5 to 2 millimeters from the horizontal surface, the clearance height of the apron being smaller than the clearance height of the convex transfer portion.

7. The device according to claim 1, wherein the raised trailing edge of the convex transfer surface forms a lowermost edge of the rotary brush chamber.

8. The device according to claim 1, wherein the rotary brush chamber is disposed between a first air duct connected to a collecting chamber and a second air duct comprising the high velocity overpressure flow through the flat nozzle.

9. The device according to claim 8, wherein the second air duct has one or more outlets and a sum of cross sections of the one or more outlets is 3 to 40% of a cross section of the first air duct.

10. The device according to claim 8, wherein the high velocity overpressure flow of air passing through the flat nozzle toward the rotary brush comprises a laminar flow of overpressure air that enters the rotary brush chamber and collides with the plurality of rotating blades of the rotary brush causing turbulence and deceleration of the overpressure air.

11. The device according to claim 1, wherein the device comprises a robotic vacuum cleaner structure and the rotary brush chamber and the flat nozzle suspended on a plurality of parallel pivoted arms mounted on pins that are rotatably mounted in lugs anchored to the robotic vacuum cleaner structure.

12. The device according to claim 1, wherein the fan is a centrifugal fan and the device comprises a flat supply channel or at least one side supply channel disposed between the flat nozzle and the centrifugal fan.

13. The device according to claim 1, wherein the device comprises a collection container fluidically connected between the rotary brush chamber and the fan.

* * * * *